US008267753B2

(12) United States Patent
Liedtke

(10) Patent No.: US 8,267,753 B2
(45) Date of Patent: Sep. 18, 2012

(54) SPINNER WHEEL HOUSING

(75) Inventor: Herbert Liedtke, Metelen (DE)

(73) Assignee: Wheelabrator Group GmbH, Metlen (DE)

( * ) Notice: Subject to any disclaimer, the term of this patent is extended or adjusted under 35 U.S.C. 154(b) by 956 days.

(21) Appl. No.: 12/224,579

(22) PCT Filed: Feb. 28, 2007

(86) PCT No.: PCT/EP2007/051922

§ 371 (c)(1),
(2), (4) Date: Dec. 5, 2008

(87) PCT Pub. No.: WO2007/099135

PCT Pub. Date: Sep. 7, 2007

(65) Prior Publication Data

US 2009/0186564 A1 Jul. 23, 2009

(30) Foreign Application Priority Data

Mar. 1, 2006 (DE) ..... 20 2006 003 208 U
Mar. 1, 2006 (DE) ..... 20 2006 003 209 U

(51) Int. Cl.
*B24B 55/04* (2006.01)

(52) U.S. Cl. ..... 451/451; 451/95; 451/97

(58) Field of Classification Search ..... 451/91, 451/94, 95, 96, 97, 451
See application file for complete search history.

(56) References Cited

U.S. PATENT DOCUMENTS

| | | | | | |
|---|---|---|---|---|---|
| 3,319,383 | A * | 5/1967 | Bowling, Jr. et al. | ..... | 451/94 |
| 3,744,190 | A * | 7/1973 | DeGroot et al. | ..... | 451/451 |
| 4,291,509 | A * | 9/1981 | Schulte et al. | ..... | 451/95 |
| 4,329,819 | A * | 5/1982 | May | ..... | 451/95 |
| 5,076,028 | A * | 12/1991 | McDade | ..... | 451/95 |
| 5,209,024 | A * | 5/1993 | Carpenter et al. | ..... | 451/95 |
| 5,846,124 | A * | 12/1998 | Rokutanda et al. | ..... | 451/95 |
| 6,835,123 | B2 * | 12/2004 | Shiga et al. | ..... | 451/94 |
| 6,949,014 | B2 * | 9/2005 | Barrier et al. | ..... | 451/95 |
| 2002/0112515 | A1 * | 8/2002 | Shiga et al. | ..... | 72/53 |

* cited by examiner

*Primary Examiner* — Timothy V Eley
(74) *Attorney, Agent, or Firm* — Karl F. Milde, Jr.; Eckert Seamans Cherin & Mellott, LLC

(57) ABSTRACT

A spinner wheel housing (100) comprises an outer housing (10) having at least one covering element (15), at least one bottom element (16), two front wall elements (11, 12) and two trapezoidal lateral wall elements (13, 14) which are arranged at a distance from each other and encompassed by the front wall elements. At least one of the lateral wall elements (13, 14) has a recess for receiving a guiding sleeve. A guiding sleeve cover (40) is pressed against this lateral wall element (14) by means of at least three clamping claw devices (50) which are fixed to the lateral wall element next to the recess for receiving the guiding sleeve and/or a bottom support element (16). The bottom element is connected to a base support element (17) by means of a plurality of clamping claw devices (70). The base bearing element is adapted to be fixed to a blasting compartment or a foundation.

12 Claims, 10 Drawing Sheets

SPINNER WHEEL HOUSING

BACKGROUND OF THE INVENTION

The invention relates to a spinner wheel housing comprising an outer housing having at least one cover element, two side elements and of two front wall elements, which are arranged at a distance to each other and are encompassed by said side elements, and of at least one liner insert that can be inserted in the outer housing and that comprises at least one liner cover element, two liner side elements and two liner front wall elements, which are arranged at a distance to each other and are encompassed by the liner side elements.

Spinner wheels are used for surface treatment of work pieces by spinning fine-grained blasting abrasives with a high speed onto the work piece surface. The spinner wheels are in essence comprised of at least one side disc with catapulting blades attached thereon, which extend essentially in the radial direction. The spinner wheel is housed in a spinner wheel housing where it is rotationally mounted. Only in one partial area at the outer circumference of the spinner wheel does the spinner wheel housing have an opening from which the blasting abrasives can exit. The remaining areas of the outer housing are closed and provided with liner elements which provide protection for the actual outer housing against the particles of the blasting abrasive. The liner elements are intended to be wear parts and therefore must be easily insertable and removable from the outer housing.

To guide the blasting abrasive in a targeted manner through the opening, it is funneled through a guiding sleeve that is arranged stationary in the center of the rotating spinner wheel. The guiding sleeve together with the adjacent blasting abrasive feeder is attached to a guiding sleeve cover, which in turn is attached to a recess at the side wall element of the outer housing. Various angular positions can be set through the flange-like connection of outer housing and guiding sleeve cover. Via a screw connection, the blast turbine is attached to a foundation or the base support element of a blast cabinet. The screws run through boreholes in the bottom elements of the outer housing.

A problem with all screw connections that engage in threaded holes is that the blast abrasive itself or the abrasion generated by the blasting process, which is partially in a powder form, can enter and freeze the screw connection. This may lead to the need to destroy the screw connection entirely in cases of repair or maintenance, for example, in order to remove the blast turbine or a guiding sleeve cover. Most often, this is accompanied by significant damage to the machine component that houses the threaded hole.

SUMMARY OF THE INVENTION

It is, therefore, the objective of the invention to make possible the removal of the screw connection even if the connection is frozen due to dirt, and to do so without damaging the spinner wheel housing with its attached parts.

This objective, as well as other objectives which will become apparent from the discussion that follows, are achieved, according to the present invention, by providing a spinner gate housing comprising an outer housing consisting of at least one covering element, at least one bottom element, two front wall elements and two trapezoidal lateral wall elements which are arranged at a distance from each other and encompassed by the front wall elements. At least one of the lateral wall elements comprises a recess for receiving a guiding sleeve. A guiding sleeve cover is pressed against the lateral wall element by means of at least three clamping claw devices which are fixed to the lateral wall element next to the recess for receiving the guiding sleeve and/or the bottom element. The bottom element is connected to a base bearing support element by means of a plurality of clamping claw devices. The base bearing element is adapted to be fixed to a blasting compartment or a foundation.

By carrying out the attachment using clamping claws, which are attached using screws and nuts and by using the arrangement of the screw heads according to the invention, threaded holes in the outer housing are avoided. The required force distribution is guided past the edges of the component to be attached. If for example the screw connection freezes, with the preferred arrangement the end portion of the screw and its nut is freely accessible from the outside of the machine housing. It can be separated easily using an angle grinder, for example, which severs the connection without damaging the machine housing. The lower part of the severed screw is located unobstructed in the T-groove and can be removed easily. The connection can be restored immediately simply by using a new screw. At the attachment points, it is not at all necessary to rework, weld or create anew the threaded holes.

The design height can be reduced through the arrangement with the screw head pointing in the direction of the outer housing, because only the part of the screw head, which is hexagonal in most cases or provided with other wrench flats, will need to be taken up inside the T-groove. If the design height is not a critical criterion, the nut can be arranged in a covered manner and the screw head can point to the outside.

Preferably, the T-groove is about as wide as the width across flats such that the inserted screw head, or nut, respectively, is secure against twisting.

In particular as an assembly aid, an embodiment with a depression machined into the groove bottom of the T-groove and ending before the open end of the T-groove is advantageous. This enables an initial light hand-tightening of the screw connection. Nonetheless, the screw head being seated in the depression in the T-groove prevents the clamping jaw device including the screw connection to slide out of the T-groove, in particular with parts assembled vertically. The same holds true for the operation: Should the screw connection loosen during operation, the nut and screw would have to separate far enough to establish an axial play of a few millimeters. Only then could the clamping claw device glide out of the T-groove.

The following advanced development is preferred for this form of clamping claw device:

The clamping claws are designed as clamping elements and have, at least at one end, an edge protruding at an angle. The clamping element is rotationally mounted to the clamping claw support element or at the base support element. The center of rotation is defined by a screw that is preferably inserted with its head in the T-groove at the clamping claw support element or at the base support element. If the screw, and therefore the center of rotation is located between the clamping claw and the clamping claw support element at the provided point of the screw connection in the T-groove, then upon a rotation—should the pretension of the screw connection weaken—the one protruding edge at the clamping claw device would freeze positively at the body of the clamping claw support element. At the same time, the screw head is defined based on the depression in the groove bottom in the area of the intended screw connection point. The screw together with the clamping element would be able to slide out of the T-groove only once the screw connection has loosened to the extent that the screw head could move out of the groove, i.e., a great axial play exists at the screw connection. If a self-locking nut is used, then the risk of such a far-reaching loosening of the screw connection, and thus the risk of the clamping claw elements sliding out, is largely eliminated.

If the screw, and thus the center of rotation is at a maximum in the front of the T-groove, then the clamping element can be turned freely. The edge of the clamping element that protrudes at an angle can get past the clamping claw support element in order to enable a simple disassembly of the component.

Should the pretension of the screw connection weaken, and the screw together with the clamping element make a move toward the open end of the T-groove, then the edge would strike prior to the clamping claw support element and prevent the screw from sliding out further. Only if the connection were loosened to the extent that the edge could slip above across the clamping claw support element, then a complete sliding off of the clamping claw device would be possible—as has already been elucidated above. Thus, hand-tightening of the screw connection is sufficient to secure the clamping claw support device during assembly.

An additional embodiment provides that a liner insert, which consists of at least two trapezoidal liner side elements and two liner front wall elements, can be inserted into the outer housing as a wear protector, whereby one liner cover element can be locked at the liner element using two clamping claws that are attached to a clamping claw support element at the outer housing. The connection design according to the invention is also advantageous for the liner cover attachment within the outer housing.

The attachment of the clamping claw support element for the liner cover can be simplified in that said clamping claw support element has a protrusion, a shoulder or a projection that is inserted into a corresponding recess on the outside of the outer housing. This connection can be realized as a press fit or can be secured using a weld spot.

If the guiding sleeve cover has to be attached to the side wall element, it is advantageous if at least three clamping claw elements, each exhibiting one T-groove, are located at the side wall element of the outer housing around the guiding sleeve receiver recess. Their open end is preferably arranged pointing away from the guiding sleeve receiving recess such that the T-grooves extend radially toward the outside with regard to the center of the guiding sleeve cover. Preferably, the bottom elements are two bottom angle brackets oriented parallel and mirror-symmetric and at a certain distance to each other. These are easy to produce, for example through bending of the side wall elements and can be clamped well using the clamping claws.

Also problematic with known spinner wheel housings is that panel-type liner elements are inserted in the outer housing in grooves. Blasting abrasive often enters the gap at the groove blocking the inserted liner side element.

It is, therefore, an additional objective of the invention, to make it easier to replace the side wear protection that is formed by the liner side wall elements.

According to the invention, this objective is achieved by a spinner wheel housing with the following features:

(1) At least one of the liner front wall elements exhibits at least one positioning cam at one side edge, and the liner side elements are provided with at least one cam receiving recess in one of the edge ranges adjacent to the side edge. The liner front wall elements can be pressed against the side edge of the liner front wall elements by means of at least one clamping claw element that is located at the outer housing.

(2) At least one of the liner front wall elements exhibits at least one cam receiver recess at a side edge and the liner side elements are each provided with a positioning cam in one edge area adjacent to the side edge. The liner front wall elements are pressed against the side edges of the liner front wall elements by means of a clamping element that is located at the outer housing.

With it, it is no longer necessary to provide a tight sliding guide for the liner side elements, instead, a wide air gap may be provided between the side edges of the liner and the outer housing, wherein the side elements can be positioned conveniently. By the fact that the side outer edge of the liner front wall elements and their respective contact areas are equipped with positioning cams at the liner side elements and corresponding to them receiving recesses, it is easy for the assembler to provide correct positioning. Thereafter, at least one clamping element is actuated, which may, for example, be a clamping screw arranged in the side element of the outer housing and used in order to press the liner side element onto the liner front wall elements.

Even if blasting abrasive enters the gap between the front and the side wall elements at the liner insert during operation, the components will no longer freeze. Rather, through the clamping screw in the outer housing, where said screw no longer has any contact with the blasting abrasive due to the protection provided by the liner insert located in front of it, the side wall element can be loosened again to the extent that it can first be pulled outward, i.e., into the air space toward the outer housing, and then pulled out.

In addition to a simple groove, other profiles are possible at the butt joints of the individual elements of the liner insert, such as, for example, double-angular or overlap-type design. The sealing ability against the blasting abrasive is also increased with the number of reversals in the joint gap.

For a full understanding of the present invention, reference should now be made to the following detailed description of the invention as illustrated in the accompanying drawing.

DESCRIPTION OF THE PREFERRED EMBODIMENTS

Figure 1:
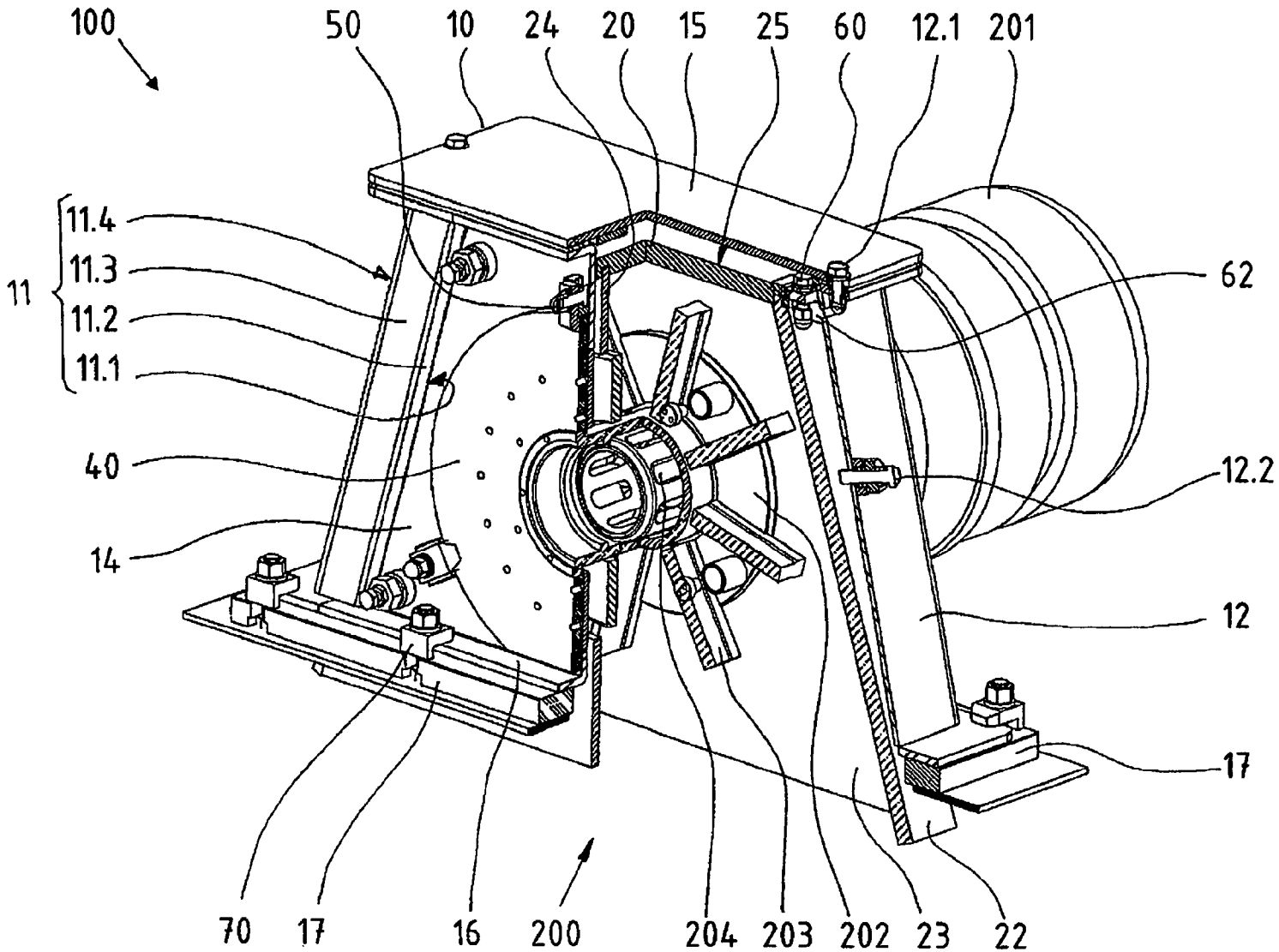
FIG. 1 is a partially sectional, perspective view of a spinner wheel housing 100 with a turbine 200 placed in it.

The preferred embodiments of the present invention will now be described with reference to FIGS. 1-9*b* of the drawings. Identical elements in the various figures are designated with the same reference numerals.

FIG. 1 shows a spinner wheel housing 100 with a turbine 200 placed in it. Essentially, the turbine 200 is comprised of a motor 201, a spinner wheel 202 with catapulting blades 203 and an impeller 204. The spinner wheel housing 100 is formed by an outer housing 10 and a liner insert 20.

The outer housing 10 surrounds the spinner wheel 202, 203, 204 except for the base area that is open toward the bottom. It is formed, among other parts, of trapezoidal front wall elements 14 that are arranged at a distance to each other, in particular oriented parallel to each other. Side wall elements 11, 12 are mounted on the side. A cover element 15 is placed on the top. The side element 11 in FIG. 1 extends from a rear flat area 11.4 to a first leg 11.3 set at a right angle to it, which is bent in turn resulting in an additional short leg 11.2 with an outer edge 11.1 that is either connected to the outer edge of the front wall element 14 on the side or directly to the surface of the front wall element 14.

A set screw 12.2 that is used to press the liner side element 22 onto the liner front elements 23, 24 is located at the outside at a receiver in the side element 12 of the outer housing 10. A screw connection 12.1 connects the flange-like bent upper edge of the side edge element 12 to a cover element 15.

A section of the outer housing 10 is shown in the right area of FIG. 1 and permits a view of the liner insert 20, which here is formed of plane steel panels.

Clamping claw elements 50, 60, 70 are employed to attach a guiding sleeve cover 40 to the wall element 14, a liner cover element 25 to the liner insert 20 and/or the entire spinner wheel housing 100. This housing has a bottom support element, comprising one or more bottom angle brackets 16, that is attached to a base support element 17.

Figure 3:
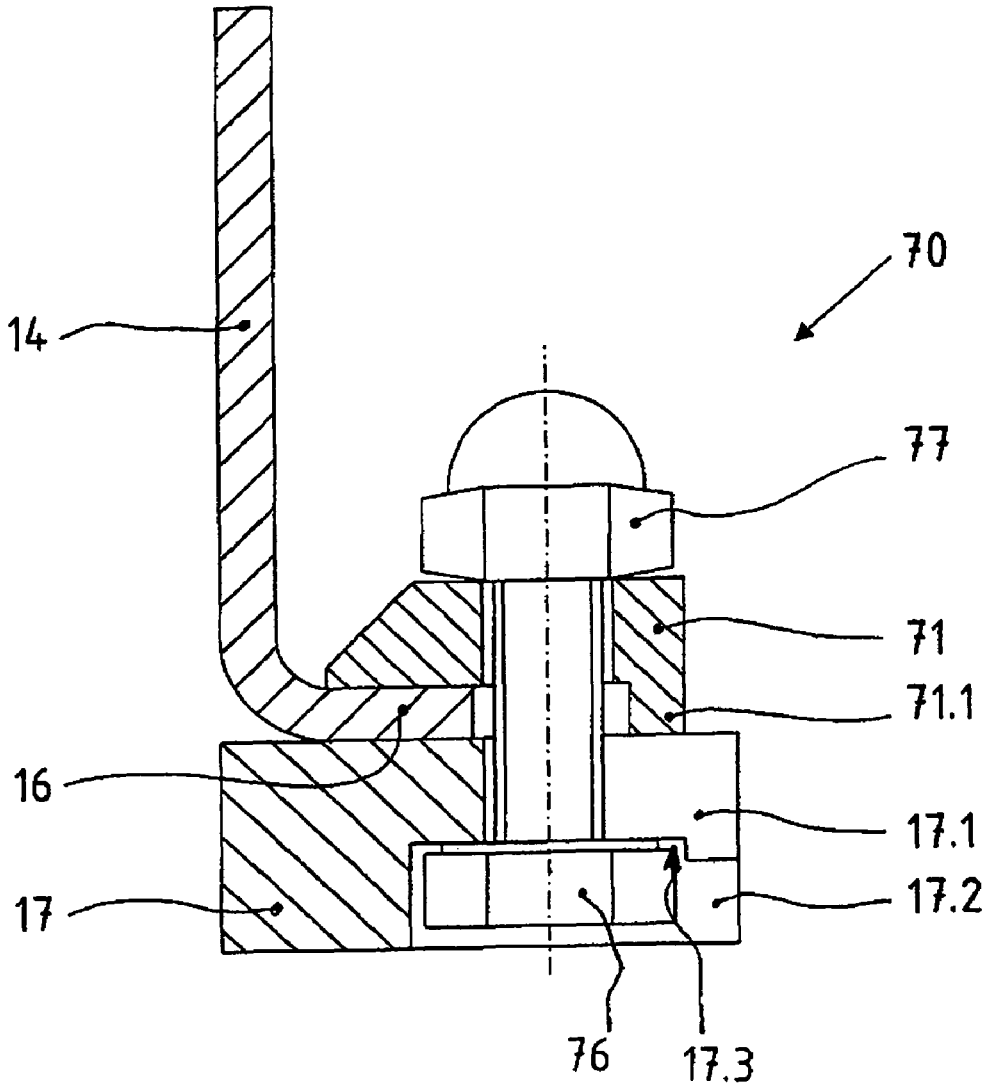
FIG. 3 is a section of clamping claw device attached to a bottom angle bracket.

At first, the structure of the clamping claw device is explained using the example of the clamping claw device 70 for the attachment of the bottom angle bracket 16 with reference to FIG. 3:

The bottom angle bracket 16 is positioned at an angle to the wall element 14 and rests on the base support element 17. A T-groove with a width in its upper section 17.1 that allows sliding in a shaft of a screw 76 from the side is provided in said base support element. The width of the lower section 17.2 corresponds to about the width across flats of the bolt head such that the bolt head is prevented from twisting in the groove. A clamping element 71 of the clamping claw device 70 bridges with its width the groove 17.1 and rests with a rear, protruding edge 71.1 on the base support element 17 on both sides of the groove 17.1. The bolt 76 runs through the clamping element 71 and is provided with a cap nut 77. Tightening the bolt connection presses the clamping element onto the bottom angle bracket 16 and clamps it tight to the base support element 17.

Figure 2D:
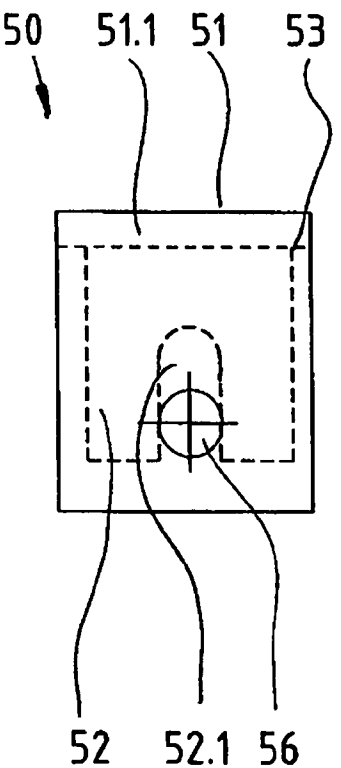
FIGS. 2*a*-2*d* show a top view of a clamping claw device in various positions.
Figure 2C:
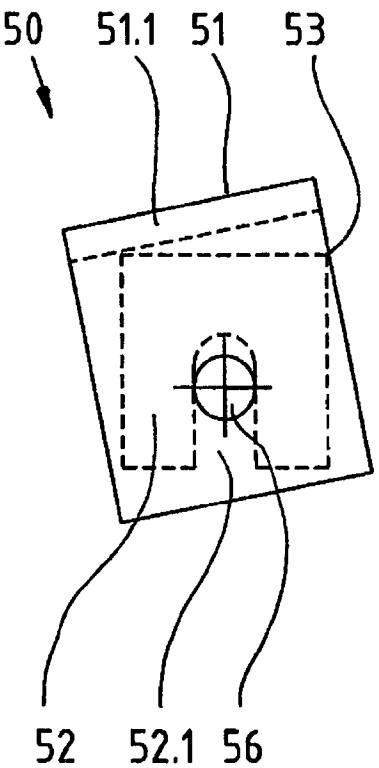
Figure 2B:
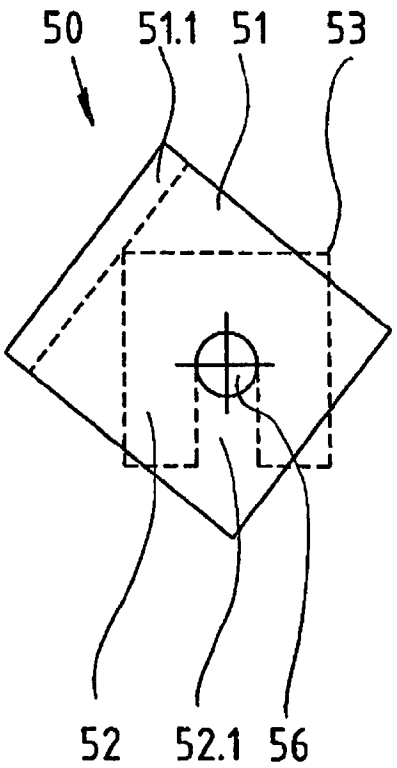
Figure 2A:
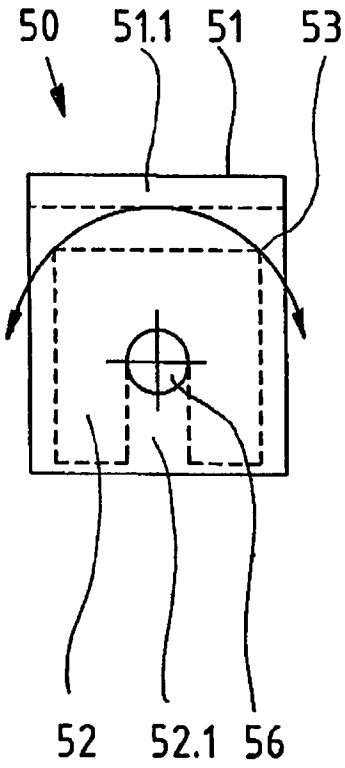

Using the example of the clamping claw device 50 for the guiding sleeve cover, FIGS. 2*a* to 2*c* show an anti-rotation protection:

FIG. 2*a* shows an initial position, where a clamping element 51 with its edge 51.1 protruding downward and oriented parallel to a clamping claw support element 52 that exhibits a groove 52.1 with a bolt 56 positioned in it. If the bolt 56 is located in the front part of the groove 52.1, the clamping element 51 can be rotated in relation to the clamping claw support element 52.

FIG. 2*b* shows how during the rotation the edge 51.1 runs past a corner 53 of the clamping claw support element 52 when the bolt is positioned fully in the front of the groove.

In FIG. 2*c*, on the other hand, the center of rotation is shifted in that the bolt 56 has a different position within the groove 52.1. The edge 51.1 now runs at a small rotational angle towards the corner 53 and is blocked at this point.

FIG. 2*d* finally shows a position in which the bolt 56 is pulled back in the groove 52.1 to the extent that the edge 51.1 contacts the front of the clamping claw support element 52. In this position, positive locking is established through the surfaces located in front of each other and rotating is no longer possible.

Figure 4:
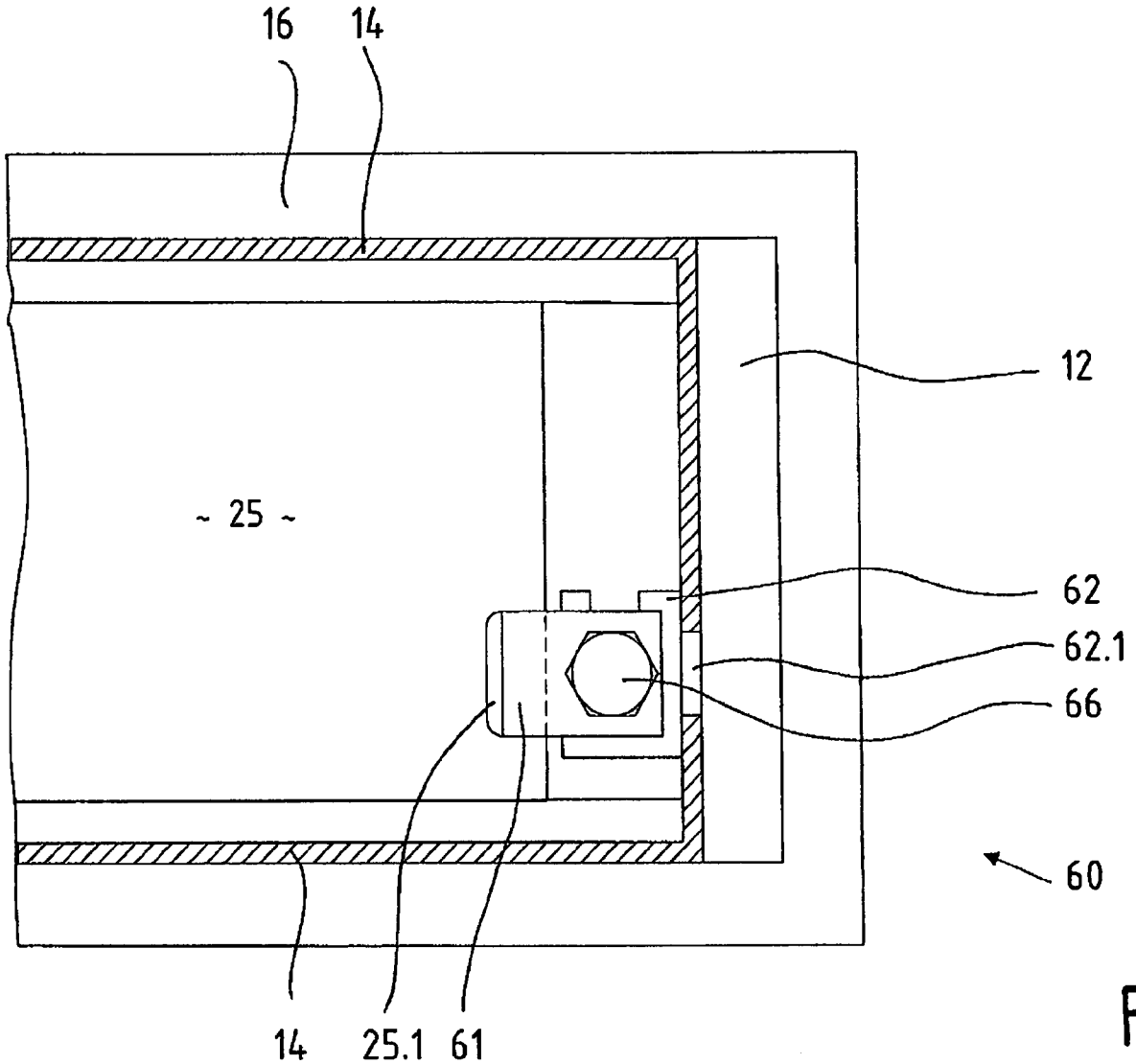
FIGS. 4 and 5 show a top view and a section of a clamping claw device at the liner cover element.

FIG. 4 shows a section of the liner cover element 25 of the liner insert 20 that is located within the outer housing 10. In FIG. 4, the front and side walls 12, 14 of the outer housing 10 and the bottom support angle 16 are visible. The liner cover element 25 includes an indentation 25.1 on the side in which a clamping element 61 of a clamping claw device 60 engages in a positive locking manner being thus defined in a rotation-protective manner. The clamping element 61 is supported by a clamping claw support element 62, which with a protrusion 62.1 is pressed into a complementary recess in the front wall 12. The connection is established via a bolt 66.

Figure 5:
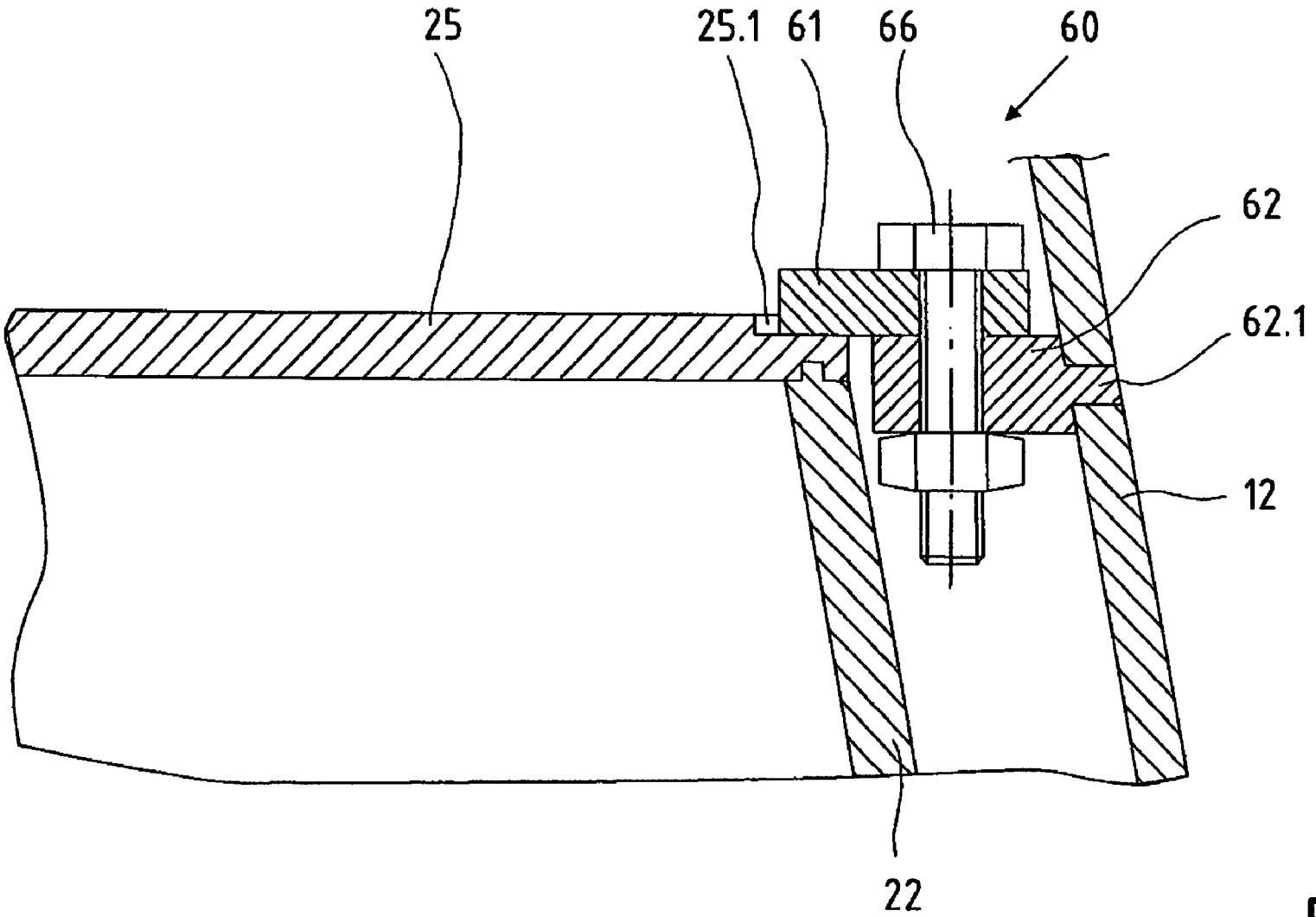

FIG. 5 presents a sectional view of the entire clamping claw device 60 for the liner cover element 25.

Figure 6:
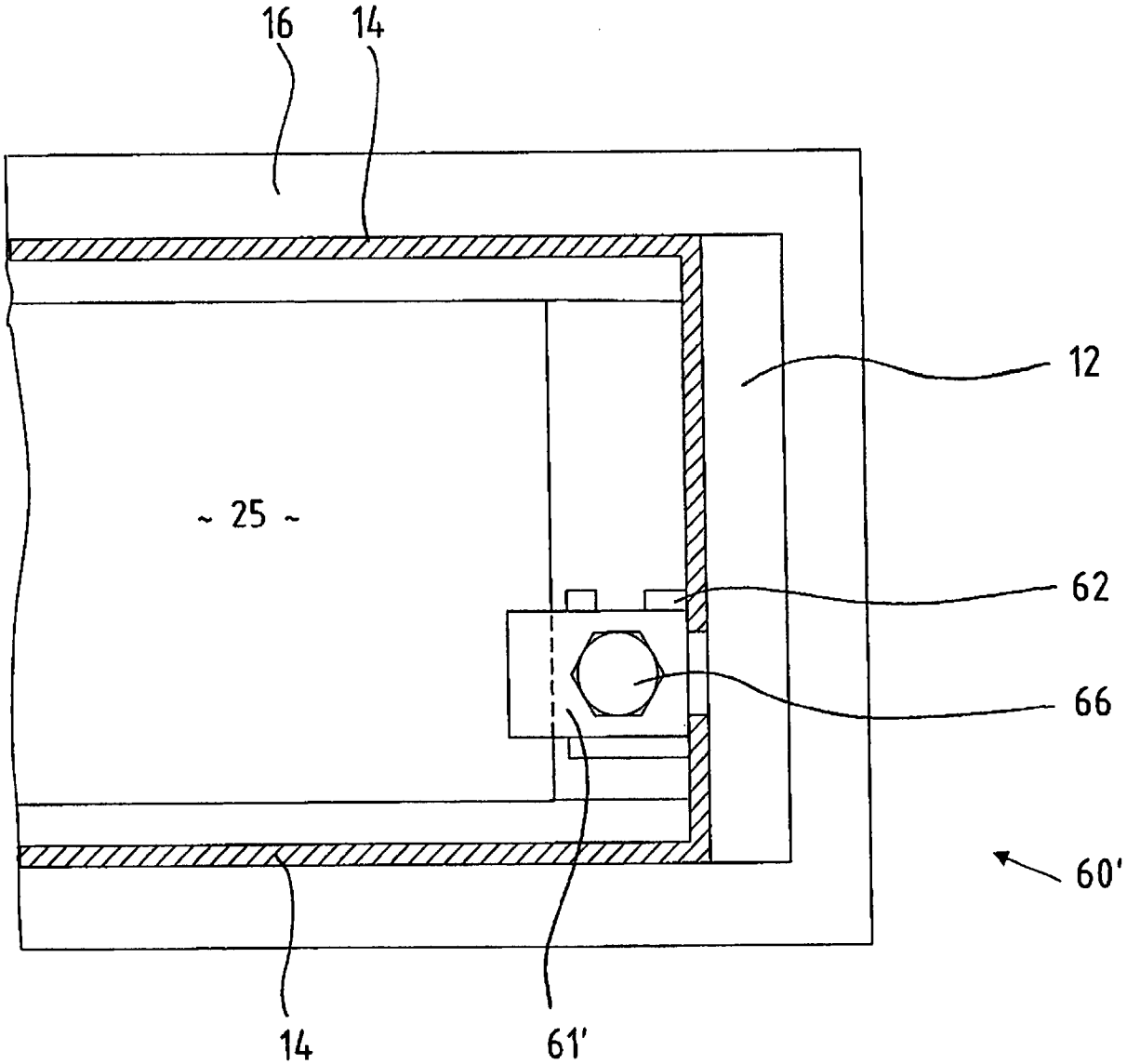
FIG. 6 is a top view of an additional embodiment of a clamping claw device at the liner cover element.

FIG. 6 shows a modification of the embodiment shown previously using FIGS. 4 and 5, whereby with the clamping claw device 60' shown here no indentation is present in the cover 25, instead a rotational protection is achieved in that a clamping element 61' rests with its rear side directly at the inside of the side wall element 12.

Figure 7:
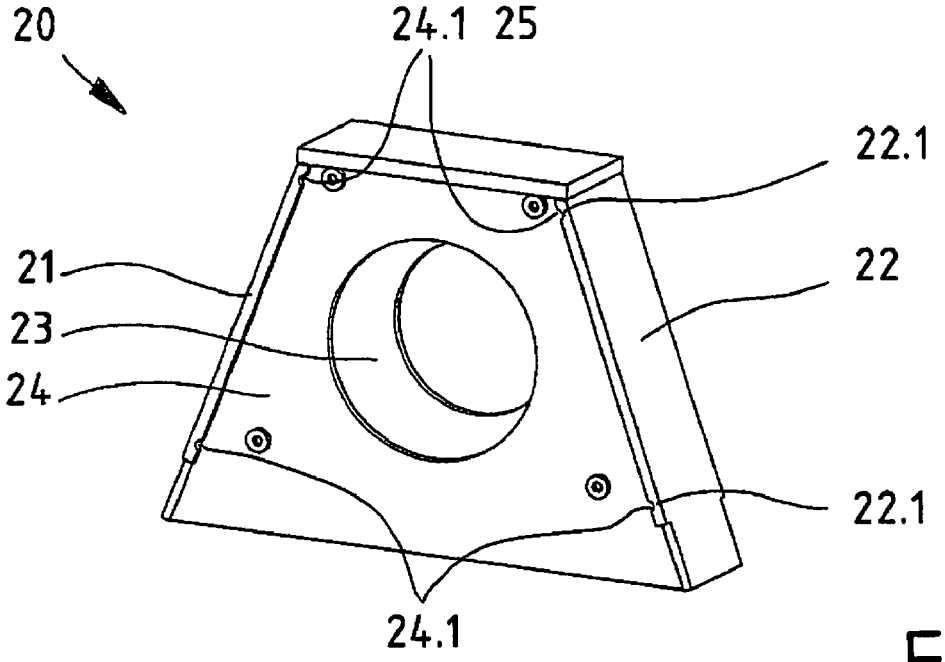
FIG. 7 is a perspective view of a liner insert.

FIG. 7 shows the separate liner insert 20, which in the shown exemplary embodiment is formed entirely of flat panels 21 . . . 25. One liner front wall element 14 and liner side wall elements 21, 22 engage with their upper edges in respective grooves in the liner cover element 25. The panel-shaped elements 21, 22, 25 are connected to each other via bracing means, which are mounted to the outer side pointing away from the spinner wheel such that there is no risk here of the blasting abrasive entering into the threaded hole of the bracing and blocking it. The front wall elements 23, 24 have large recesses for inserting and carrying the turbine with the spinner wheel.

Figure 8:
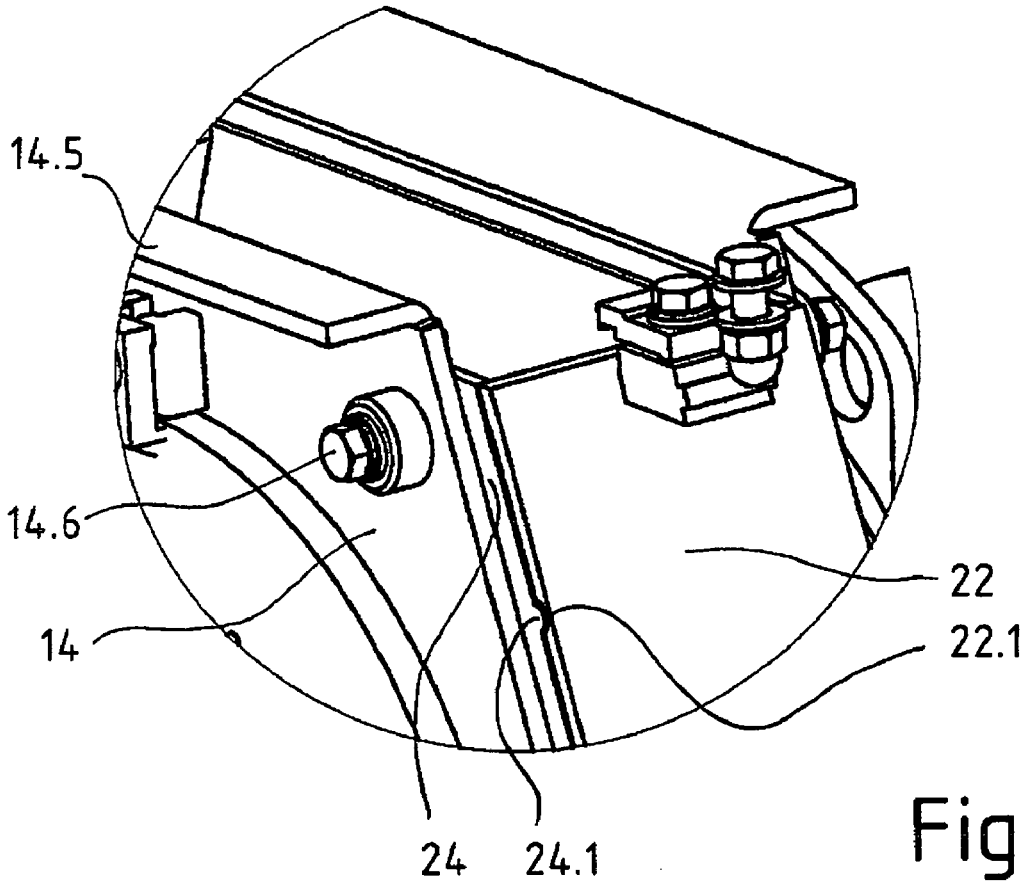
FIG. 8 is a detail view of the spinner wheel housing of FIG. 1.

FIG. 8 shows a detail section of the spinner wheel housing at the transition from the cover to the side. Here, the cover of the outer housing has been taken off. The front wall 14 is positively connected to the front wall liner element 24 via a screw connection 14.6. Toward the top, the front wall 14 terminates through a flange 14.5. At its side edge, the front wall liner 24 has positioning cams 24.1, one of which is shown in FIG. 3. A respective corresponding cam receiver recess is formed into the counter side at the liner side element 22. An irregular arrangement of the positioning cams is possible, for example in order to identify unmistakably the right and left side wall elements 22, 23, as well as a symmetrical arrangement to obtain identical side wall elements 22, 23 such that only one type of replacement part is necessary as a wear part for the side wall elements.

Figure 9A:
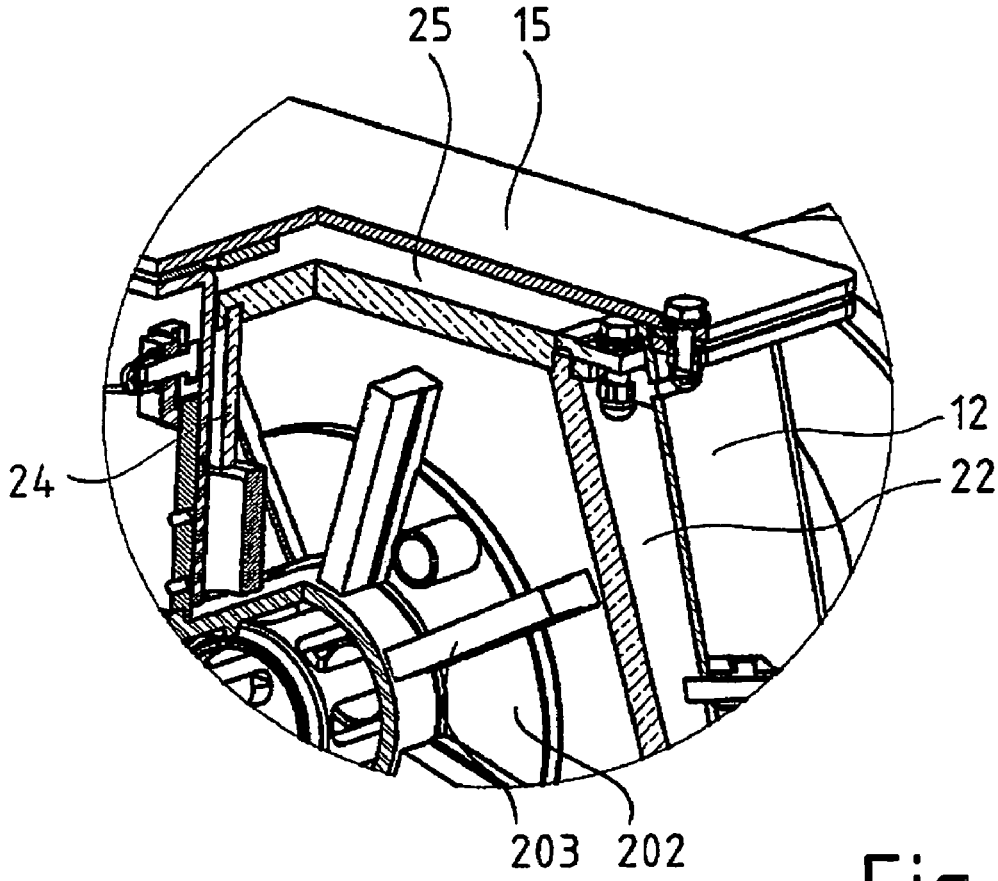
FIG. 9*a* is a detail view of a first connection of liner elements at the spinner wheel housing of FIG. 1.

FIG. 9*a* shows a detail view of the connection of the liner elements 22, 24, 25. Here, one can notice in particular that grooves are provided in the cover element 25 with the elements 22, 24 inserted into them.

Figure 9B:
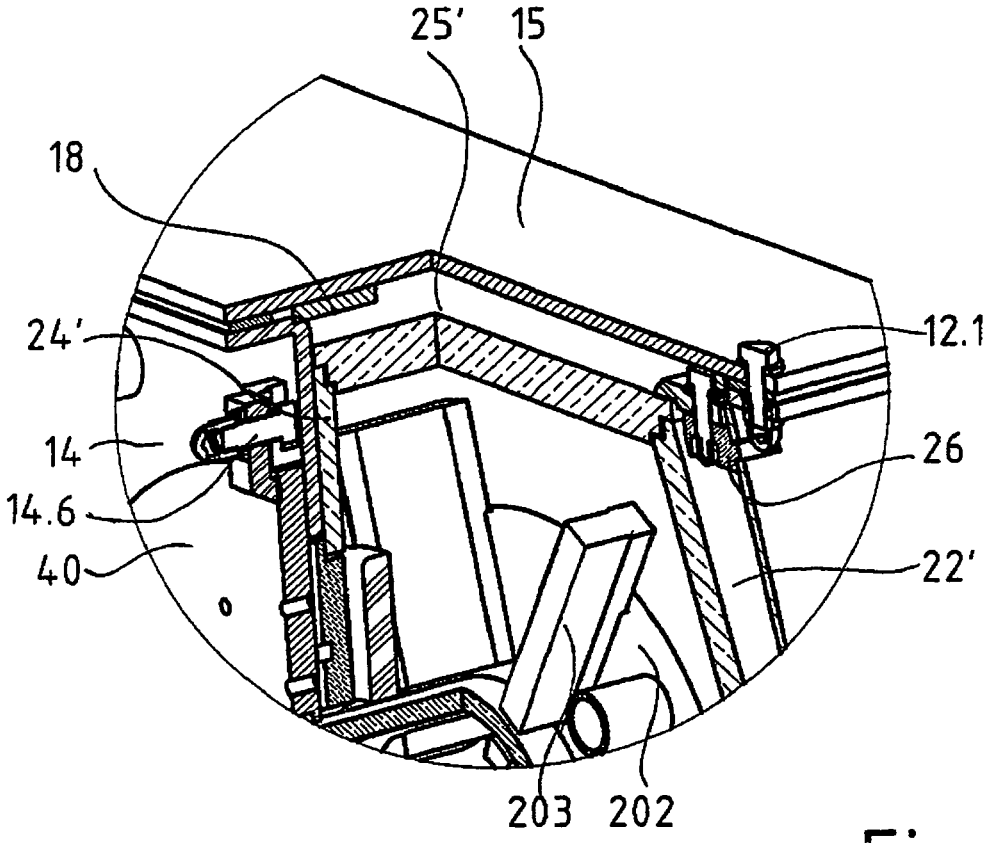
FIG. 9*b* is a detail view of a second connection of liner elements.

FIG. 9*b* shows a slightly modified connection method. Here, the side wall elements 22' and the front wall element 24' are provided with a stepped overlap-type upper edge. The outer edges of the cover element 25' are formed in a complementary fashion. The overlap-type design of this connection provides a space-saving joint without overhang of the cover element with a triple reversal of direction in the joint gap and a respective good sealing effect against entering blasting abrasives.

There has thus been shown and described a novel spinner wheel housing which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A spinner wheel housing comprising an outer housing having at least one cover element, at least one bottom support element, two front wall elements and two trapezoidal side wall elements, which are arranged at a distance from each other and encompassed by said front wall elements;

wherein at least one of the side wall elements includes a recess for receiving a guiding sleeve, with at least one liner insert that can be inserted in the outer housing, with said liner insert comprising at least one liner cover element, two liner side elements and two liner front wall elements, which are arranged at a distance from each other and encompassed by said front wall elements;

the improvement wherein a guiding sleeve cover is pressed against one of the side wall elements by means of at least three clamping claw devices that are attached to said at least one side wall element next to the recess for receiving the guiding sleeve, and a bottom support element which is connected to a base support element by means of several clamping claw devices, whereby said base support element is adapted to be attached to a blast cabinet or to a foundation; and wherein each of the clamping claw devices is fastened by a bolt and a nut, whereby a bolt head of said bolt is inserted into a T-groove that is opened at least on one side and is located at at least one of the side wall element, the guiding sleeve cover, the bottom support element and at the base support element.

2. A spinner wheel housing as defined in claim 1, wherein at least one of the bolt head and the nut is provided with wrench flats and where the width across the flats corresponds essentially to the width of one wide part of the T-groove.

3. A spinner wheel housing as defined in claim 1, wherein an indentation that ends before an open end of the T-groove is provided in a bottom of the T-groove.

4. A spinner wheel housing as defined in claim 1, wherein the liner cover element is locked by means of a clamping claw device that is attached at a clamping claw support element at the outer housing and lockable to the liner insert.

5. A spinner wheel housing as defined in claim 4, wherein the liner cover element exhibits an indentation at at least two opposing outer edges for engaging a clamping element of a clamping claw element.

6. A spinner wheel housing as defined in claim 1, wherein a clamping claw support element has a protrusion which engages in a complementary recess in the front wall element of the housing.

7. A spinner wheel housing as defined in claim 1, wherein the clamping claw devices comprise at least one clamping element, which at its end side exhibits at least one edge protruding at an angle and is supported at at least one clamping claw support element and at the base element in such a manner that each edge of the clamping element, through a rotation around a center of rotation defined by an end position of the bolt in the T-groove, runs past the clamping claw support element and wherein at least one edge is locked positively by the clamping claw support element for a rotation around a center of rotation at a distance from it in an end section of the T-groove.

8. A spinner wheel housing as defined in claim 1, wherein at the side wall element of the housing, around the guiding sleeve receiving recess, at least three clamping claw elements are positioned that are each inserted in a respective T-groove.

9. A spinner wheel housing as defined in claim 8, wherein a respective open end of the T-groove points away from the guiding sleeve receiver recess.

10. A spinner wheel housing as defined in claim 9, wherein the T-grooves extend radially outward with respect to the center of the guiding sleeve cover.

11. A spinner wheel housing as defined in claim 8, wherein at least one clamping claw element engages in a recess located at an outer edge of the guiding sleeve cover.

12. A spinner wheel housing as defined in claim 1, wherein the at least one bottom support element includes two bottom angle brackets that are spaced at a distance to each other and are oriented parallel and mirror-symmetric to each other.

* * * * *